US011192124B2

(12) United States Patent
Russell et al.

(10) Patent No.: US 11,192,124 B2
(45) Date of Patent: Dec. 7, 2021

(54) FLUIDIC SCANNER NOZZLE AND SPRAY UNIT EMPLOYING SAME

(71) Applicant: DLHBOWLES, INC., Canton, OH (US)

(72) Inventors: Gregory A. Russell, Catonsville, MD (US); Russell Hester, Odenton, MD (US)

(73) Assignee: DLHBOWLES, INC., Canton, OH (US)

( * ) Notice: Subject to any disclaimer, the term of this patent is extended or adjusted under 35 U.S.C. 154(b) by 0 days.

(21) Appl. No.: 16/094,221

(22) PCT Filed: May 3, 2017

(86) PCT No.: PCT/US2017/030813
§ 371 (c)(1),
(2) Date: Oct. 17, 2018

(87) PCT Pub. No.: WO2017/192704
PCT Pub. Date: Nov. 9, 2017

(65) Prior Publication Data

US 2019/0201918 A1 Jul. 4, 2019

Related U.S. Application Data

(60) Provisional application No. 62/330,930, filed on May 3, 2016.

(51) Int. Cl.
*B05B 1/18* (2006.01)
*B05B 1/08* (2006.01)

(52) U.S. Cl.
CPC ..... *B05B 1/185* (2013.01); *B05B 1/08* (2013.01)

(58) Field of Classification Search
CPC .. B05B 1/18; B05B 1/185; B05B 1/08; E03C 1/0408
(Continued)

(56) References Cited

U.S. PATENT DOCUMENTS 3,185,166 A 5/1965 Horton et al.
3,563,462 A 2/1971 Bauer
(Continued)

FOREIGN PATENT DOCUMENTS

CN 204620233 9/2015
WO 2017091732 6/2017

OTHER PUBLICATIONS

Patent Cooperation Treaty (PCT), International Search Report and Written Opinion for Application PCT/US2017030813 filed May 3, 2017, dated Oct. 2, 2017, International Searching Authority, US.
(Continued)

*Primary Examiner* — Joseph A Greenlund
(74) *Attorney, Agent, or Firm* — McDonald Hopkins LLC

(57) ABSTRACT

A fluidic nozzle of the scanner type has its outlet spray pattern skewed from its chamber axis (A) by an amount determined by the asymmetry of its outlet orifice (23, 33) about that axis. A spray assembly (70, 90) of such nozzles, such as a showerhead, can be designed using nozzles with selected pattern skew angles to achieve desired spray coverage. Indexing tabs (97) and slots (96) are used to angularly position the nozzles in the showerhead. A portion of each nozzle may be formed with the showerhead faceplate (71) as an integral piece.

8 Claims, 9 Drawing Sheets

(58) Field of Classification Search
USPC ..... 239/589, 589.1
See application file for complete search history.

(56) References Cited

U.S. PATENT DOCUMENTS

| | | | | |
|---|---|---|---|---|
| 4,052,002 | A * | 10/1977 | Stouffer | A61C 17/028 239/4 |
| 4,122,845 | A * | 10/1978 | Stouffer | A61C 17/028 239/589.1 |
| 4,151,955 | A | 5/1979 | Stouffer | |
| 4,157,161 | A * | 6/1979 | Bauer | B05B 1/08 137/830 |
| 4,184,636 | A | 1/1980 | Bauer | |
| 4,231,519 | A | 11/1980 | Bauer | |
| 4,508,267 | A | 4/1985 | Stouffer | |
| 5,035,361 | A | 7/1991 | Stouffer | |
| 5,213,269 | A | 5/1993 | Srinath et al. | |
| 5,246,301 | A | 9/1993 | Hirasawa | |
| 5,971,301 | A | 10/1999 | Stouffer et al. | |
| 6,186,409 | B1 | 2/2001 | Srinath et al. | |
| 6,240,945 | B1 * | 6/2001 | Srinath | B05B 1/08 137/14 |
| 6,253,782 | B1 | 7/2001 | Raghu | |
| 6,328,228 | B1 * | 12/2001 | Bossini | B05B 1/1645 239/390 |
| 6,938,835 | B1 * | 9/2005 | Stouffer | B05B 1/08 137/808 |
| 6,948,244 | B1 | 9/2005 | Crockett | |
| 7,111,800 | B2 | 9/2006 | Berning et al. | |
| 7,677,480 | B2 | 3/2010 | Russell | |
| 7,740,186 | B2 | 6/2010 | Macan et al. | |
| 8,205,812 | B2 | 6/2012 | Hester et al. | |
| 10,239,083 | B2 * | 3/2019 | Gopalan | B60S 1/46 |
| 2002/0109023 | A1 | 8/2002 | Thomas et al. | |
| 2006/0043110 | A1 * | 3/2006 | Miyauchi | B05B 1/08 222/129.1 |
| 2006/0108442 | A1 | 5/2006 | Russell et al. | |
| 2007/0158477 | A1 | 7/2007 | Wu et al. | |
| 2008/0073451 | A1 * | 3/2008 | Bradbury | B05B 1/04 239/599 |
| 2010/0072307 | A1 | 3/2010 | Hester et al. | |
| 2011/0233301 | A1 * | 9/2011 | Gopalan | B05B 1/08 239/101 |
| 2012/0175438 | A1 * | 7/2012 | Ji | B05B 1/08 239/601 |
| 2013/0299608 | A1 * | 11/2013 | Spangler | B05B 1/08 239/444 |
| 2016/0082447 | A1 * | 3/2016 | Gong | B05B 1/08 239/461 |
| 2016/0228885 | A1 * | 8/2016 | Cutler | B05B 1/185 |
| 2016/0318045 | A1 * | 11/2016 | Huffington | B05B 1/185 |
| 2018/0318855 | A1 * | 11/2018 | Russell | B05B 1/18 |
| 2019/0060920 | A1 * | 2/2019 | Currie | B05B 3/16 |
| 2019/0201918 | A1 * | 7/2019 | Russell | B05B 1/08 |

OTHER PUBLICATIONS

International Search Report and Written Opinion dated Apr. 17, 2017; International Patent Application No. PCT/US2016/063608 filed on Nov. 23, 2016. ISA/US.

* cited by examiner

FLUIDIC SCANNER NOZZLE AND SPRAY UNIT EMPLOYING SAME

CROSS REFERENCE TO RELATED APPLICATIONS

The present application is a 35 U.S.C. 371 national stage filing and claims priority to and the benefit of International Application No. PCT/US2017/030813 filed on May 3, 2017, which is a non-provisional application of and claims priority to U.S. Provisional Application No. 62/330,930, entitled "Scanner Nozzle Aim Structure and Method, Aimed Scanner Nozzle Array and Method," filed May 3, 2016, the disclosure of which are hereby incorporated by reference herein in their entirety.

BACKGROUND

Technical Field

The present invention pertains generally to methods and apparatus for fluidically generating desired fluid spray patterns, primarily liquid patterns sprayed in droplets to reliably wet a target area. In a more particular aspect, the invention pertains to enhancements to fluidic oscillator nozzles, their use in spray assemblies (e.g., showerheads) configured to generate a plurality of predeterminedly aimed three-dimensional oscillating sprays of fluid droplets from a plurality of fluidic scanner nozzles, and methods of fabricating such assemblies.

Discussion of the Prior Art

It is known in the prior art to design fluidic oscillators as nozzles that generate spray patterns of liquid droplets resulting from a cyclically deflected liquid jet, as well as nozzle assemblies employing multiple such fluidic oscillators and methods of integrating the geometry of such fluidic oscillators into the nozzle structure. Examples of such designs are found in Applicant's commonly owned prior U.S. Pat. No. 4,122,845 (Stouffer et al.), U.S. Pat. No. 6,240,945 (Srinath et al.), U.S. Pat. No. 6,948,244 (Crockett), U.S. Pat. No. 7,111,800 (Berning et al.), U.S. Pat. No. 7,677,480 (Russell et al.) and U.S. Pat. No. 8,205,812 (Hester et al.), and U.S. Pub. No. 2011/0233301 (Gopalan et al.), the disclosures in which are incorporated herein in their entireties to provide background and nomenclature reference and to enable persons of skill in the art to better understand the methods and apparatus of the present invention.

FIGS. 1A and 1B of the accompanying drawings schematically illustrate the fluidic oscillator disclosed Applicant's U.S. Pat. No. 6,938,835 (Stouffer), the disclosure in which is incorporated herein in its entirety. That oscillator 10 is known as a scanner-type oscillator and generates a randomly sweeping three-dimensional spray pattern to cover a substantially circular target area. This is achieved by forcing water under pressure through a cylindrical interaction/oscillation chamber 11 defined between longitudinally spaced upstream end member 12 and downstream end member 13 having respective axially aligned inlet 14 and outlet 15 apertures, or orifices, defined therethrough. More specifically, these inlet and outlet apertures are each symmetric about their own centroids, and symmetrically and concentrically disposed about the central longitudinal axis A of chamber 11. The inlet aperture in the upstream end member 12 is configured to be coupled to a source P+ of liquid (e.g., water) under pressure for issuing a jet of liquid into the oscillation chamber. The outlet orifice 15 in the downstream end member discharges a spray of the pressurized liquid to atmosphere and typically onto an area of a surface to be wetted. The cylindrical oscillation chamber 11 is configured to support the generation and volumetric oscillation of a toroidal vortex flow pattern. More specifically, a portion of the periphery of the liquid jet that does not exit through outlet orifice 15 is fed back upstream around the jet to form a three-dimensional vortical flow pattern (i.e., a doughnut or toroidal shaped vortical flow) axially centered about the chamber longitudinal axis A. Random perturbations in the flowing liquid cause the vortical flow in the toroid to become diametrically unstable such that the toroid transverse cross-section randomly increases along one angular section of the chamber and correspondingly decreases in the toroid section at the opposite side of the chamber. This is illustrated diagrammatically in FIG. 1A by the larger oval on one side of the liquid jet and the correspondingly smaller oval on the diametrically opposite side of the jet. In FIG. 1B the oval sizes are seen to have reversed position, indicating that the diameters of vortical flow at those locations of the toroid have reversed at some point in time. The jet flowing through the chamber will be deflected away from the larger diameter portion of the toroid and, when so deflected, will cause the spray pattern produced by the jet at outlet orifice 15 to be deflected accordingly. The randomly oscillating three-dimensional deflection of the jet in chamber 11 causes the resulting oscillating outlet jet to break up into a generally conical pattern of liquid droplets about a spray axis that is substantially coaxial with chamber axis A. More particularly, the outflowing jet is randomly deflected both transversely (i.e., radially) relative to the chamber axis A and angularly (i.e., tangentially) relative to that axis, and as a result of such deflection generates a spray pattern of droplets that covers a predetermined area of a target.

Applicant's prior research and development in designing and manufacturing nozzle assemblies and components have resulted in several new structures and methods for generating fluid or liquid sprays having unique spray patterns of appropriately sized droplets which are projected toward a desired target area or in a pre-defined spray direction at a desired droplet velocity. These developments have, in turn, fostered customer requests for even more specialized nozzle assemblies and components to solve specific problems or provide creative spray patterns. For example, showerheads with applicant's fluidic oscillators have achieved some significant commercial success, partly because they provide pleasing sprays without requiring excessive flow rates.

Many considerations go into the design of a functionally and aesthetically pleasing showerhead. For example, a showerhead typically includes a faceplate perforated to issue a plurality of water jets in a spray pattern that covers a predetermined large solid angle; part of the showerhead design process involves configuring the faceplate to provide a desired spray pattern. Further, in water conserving designs, less water is used to shower or wet a given area, and it is recognized that low flow showerheads can use water more efficiently by aerating the water stream. Further, some showerheads are designed to be adjustable to issue different spray patterns. Another consideration is the fact that hard water may result in calcium and magnesium deposits clogging the head, reducing the flow and changing the spray pattern. These design issues and many others are described in U.S. Pat. No. 7,740,186 (Macan et al.) and the prior art cited therein.

Rain can style showerheads have become increasingly popular because they provide the user with a gentle rain-like shower pattern of spray with the goal of drenching the user's entire body with just enough pressure to make it mildly invigorating. The desired sensation for users has been described as a "natural rainfall experience". A rain can shower head issues its gentle spray pattern from an array of outlets defined through a faceplate surface, and is traditionally mounted on a long gooseneck shower arm to provide an above-the-head position, but can also be configured for use on a traditional showerhead-supporting pipe nipple projecting from an elevated position on a wall. The rain can shower head typically has a front face that is larger than that of an ordinary shower head in order that the parallel streams issued from its respective outlets might provide maximum coverage. For example, such a showerhead may have a six-inch-diameter face with forty (40) or more spray channels in an effort to provide the full-body drenching spray that simulates rainfall. The effect desired can be characterized as a relatively uniform spray originating from co-planar openings in a larger surface area than is provided by a typical showerhead.

Stationary spray heads with fixed jets are the simplest of all spray heads, consisting essentially of a water chamber or manifold and one or more outlet orifices issuing respective jets directed to produce a constant single or multi-jet pattern. Stationary spray heads with adjustable outlet orifices are typically of a similar construction, except that it is possible to make some adjustment of the outlet opening size and/or the number of outlets utilized. However, such outlets in showerheads issue straight jets that continuously impact essentially the same location on a user's skin, often causing a stinging type discomfort. Rain can spray heads represent an effort to reduce this discomfort by enlarging the area emitting the sprays; however, the resulting spray is often too gentle for many users who enjoy a shower spray that produces a pleasant but not painful impact on the body without discomfort.

Fluidic oscillators are known in the prior art for providing a wide range of liquid spray patterns by cyclically deflecting a liquid jet fluidically, i.e., without the use of mechanical moving parts. The absence of moving parts to effect jet deflection has the advantage of fluidic oscillators not being subject to the wear and tear that adversely affects the reliability and operation of pneumatic and reciprocating nozzles. Examples of fluidic oscillators may be found in many patents, including U.S. Pat. No. 3,185,166 (Horton & Bowles), U.S. Pat. No. 3,563,462 (Bauer), U.S. Pat. No. 4,052,002 (Stouffer & Bray), U.S. Pat. No. 4,151,955 (Stouffer), U.S. Pat. No. 4,157,161 (Bauer), U.S. Pat. No. 4,231,519 (Stouffer), U.S. Pat. No. 4,508,267 (Stouffer), U.S. Pat. No. 5,035,361 (Stouffer), U.S. Pat. No. 5,213,269 (Srinath), U.S. Pat. No. 5,971,301 (Stouffer), U.S. Pat. No. 6,186,409 (Srinath), U.S. Pat. No. 6,253,782 (Raghu) and U.S. Pat. No. 6,938,835 (Stouffer). The disclosures in these patents are incorporated herein for reference and background purposes regarding the various ways in which fluid jets can be fluidically deflected.

Fluidic oscillators, as described in these and other patents, are capable of issuing an oscillating jet that breaks up into a spray of droplets which are much more like rainfall than the water-drilling static spray from a standard showerhead. Unfortunately, it is not a trivial matter to replace several nozzles generating static jets with plural fluidic oscillators. Typical rain can showerhead assemblies have a plurality of nozzles fed via a bowl-shaped water chamber or manifold with a central flow inlet which is configured with a pivoting ball joint so that the shower head assembly can be aimed. In such cases, because of the nature of the inlet, the flow inside the manifold becomes highly turbulent, with the result that flow to each outlet orifice differs from the flow to adjacent outlet orifices, and flow to any individual outlet orifice is variable over time. Fluidic scanner nozzle inserts are also sensitive to such turbulence, as well as to problems pertaining to sealing each insert in the housing. Therefore, a traditional showerhead incorporating the above-described fluidic elements likely may not spray as intended because turbulent inlet or manifold flow disrupts the operation of fluidic oscillators.

In U.S. Pub. No. 2011/0233301 (Gopalan et al., cited above) there is disclosed a rain can type showerhead having a manifold for delivering received water under pressure to an array of multiple fluidic oscillator inserts in a faceplate. Although that showerhead is quite satisfactory for most purposes, neither that showerhead nor any of those described in the other above-cited patents provides arrays of fluidic scanner nozzles in a single molded piece having varying aim angles to permit predetermined contouring of overall combined spray patterns. There is also no disclosed approach to reliably providing larger coverage areas and more uniform coverage across the target area. Finally, there is no practical way disclosed in the prior art of making the egress orifice throat side of the multi-nozzle scanner array in one piece.

Terminology

It is to be understood that, unless otherwise stated or contextually evident, as used herein:

- The terms "axial", "axially", "longitudinal", "longitudinally", etc., refer to dimensions extending parallel to the longitudinal axis of an interaction chamber in a fluidic device.
- The terms "radial", "lateral", "transverse", etc., refer to dimensions extending perpendicularly from the interaction chamber axis.
- The terms "angle", "angular", "rotationally", etc., unless otherwise stated, refer to angular dimensions relative to the interaction chamber axis.
- The terms "up", "down", "upper", "lower", "upward", "downward", "top" and "bottom" are used herein for convenience only in describing parts and their positions as they appear in the drawings and are not to be construed as limiting positions and orientations parts of the inventions and parts thereof.
- The term "centroid" as used herein refers to the geometric center of a two dimensional object such as an orifice.

SUMMARY OF THE INVENTION

Fluidic scanner nozzles of the present invention overcome the difficulties described above by providing outlet orifice configurations that permit nozzle designers to achieve differently and selectively aimed scanning sprays that have particular utility in fluidic showerheads. The geometries of the scanner nozzles and their methods of manufacture permit use of a minimum of parts and provide for economical and effective sealing between parts. More specifically, plural scanner nozzles, or parts thereof, may be molded in simple open and close tooling as one piece in a scanner array with the individual nozzles configured to have their respective spray configurations predeterminedly aimed to effect a desired overall spray pattern from the array. Still more specifically, the outlet orifice or "throat" portions of the scanner nozzles in the array are molded with appropriate aiming configurations as one piece. The nozzle aim angle variations across the array allows for nozzle assemblies capable of reliably generating sprays with larger coverage areas and more uniform droplet coverage across a target area. The particular advantage of this method of aiming or yawing the sprays is that, when molding the scanner array, a very simple shutoff, perpendicular to the draw of the mold, is maintained over all scanners in the array. This is also an advantage, though not as great, when making even a single aimed scanner nozzle outlet orifice geometry.

According to the present invention an asymmetrical or off-axis outlet orifice or throat is provided to predeterminedly direct or aim the generally conical scanner nozzle output spray. In one disclosed embodiment the divergence angle from the nozzle chamber axis of the centerline of the generally conical outlet spray pattern is about one-third of the maximum angle between the asymmetric outlet orifice and chamber axis.

In accordance with an aspect of the present invention, a scanner nozzle inlet orifice is symmetrically defined about the chamber axis, but its outlet orifice is not to thereby define an "aiming" aperture or throat. The required asymmetry of the outlet aperture may result from it being asymmetrical about its centroid with the centroid disposed on the chamber axis, or by being symmetrical about its centroid but with the centroid transversely displaced from the chamber axis, or both.

In accordance with the present invention, outlet parts of an array of fluidic scanner nozzles may be molded in a single molded piece whereby different individual scanner nozzles can have different respective aim angles. The aim angle variation across the array allows for nozzle assemblies capable of reliably generating sprays with larger coverage areas and more uniform sprayed fluid droplet coverage across a target area.

In accordance with one aspect of the present invention, the fluidic scanner oscillator of the type described above in connection with FIGS. 1A and 1B is modified such that its outlet orifice is asymmetric relative to the chamber axis. This asymmetry may be the result of the orifice perimeter being asymmetric about its own centroid while disposed on or about the chamber axis, or the orifice centroid being transversely displaced from the chamber axis, or both. In the preferred embodiment the asymmetry is provided by the perimeter of the orifice being asymmetric about the orifice centroid. In any case, the asymmetry causes the transversely and angularly deflected outlet jet to be redirected to an extent determined by the particular asymmetry. As a consequence, the axis of the generally conical scanning spray pattern is skewed, or yawed, from the chamber axis, thereby permitting the spray to be aimed as desired by the orifice geometry. The scanner oscillator of the invention includes an interaction chamber that can have any of a variety of configurations to produce the desired spray pattern and, in a preferred embodiment, is generally spherical or formed from two spherical segments joined at their bases. Also in the preferred embodiment, the asymmetric outlet orifice periphery takes the form of an axially short (i.e., short relative to the axial length of the chamber) frustum converging in a downstream direction.

In accordance with another aspect of the invention a plurality of the modified scanner oscillator nozzles are deployed in an array in a spray unit, such as a showerhead. The designed aim angles of the nozzles and their positions in the array permit the spray unit designer to preselect desired overall spray patterns. A given spray pattern provided by the array of the aimed scanner nozzles can be produced by fewer nozzles than the number of openings required for a conventional spray head that issues parallel static streams. As a result, the spray head with the aimed scanner nozzles may be smaller than conventional spray heads and, since fewer nozzles are used, the amount of water required to cover a given target is less.

In another aspect of the invention a fluidic scanner nozzle comprises an interaction chamber defined longitudinally between upstream and downstream walls and surrounded transversely. The upstream wall has an inlet opening defined therein for receiving pressurized liquid and delivering it as a jet into the chamber along a chamber longitudinal axis. The downstream wall has an outlet orifice defined therein for issuing a liquid spray from the chamber into ambient environment surrounding the nozzle. To permit aiming or skewing the outlet spray pattern from the chamber axis, the outlet orifice may have a perimeter that is asymmetrically disposed relative to the chamber axis. The inlet opening and outlet orifice may be at least partially longitudinally aligned along the chamber axis, and the outlet orifice may have a generally frustoconical configuration converging outwardly from the chamber and disposed asymmetrically about the chamber axis.

The improved fluidic scanner oscillator described above has utility in a wide variety of applications and may be used as an individual oscillator or as a combination of oscillators. The spray producing assembly of oscillators described above is not limited to showerheads; rather, it can be used to provide designed sprays for any type of sprayer application.

The above and still further features and advantages of the present invention will become apparent upon consideration of the definitions, descriptions and descriptive figures of specific embodiments thereof set forth herein. In the detailed description below, like reference numerals in the various figures are utilized to designate like components and elements, and like terms are used to refer to similar or corresponding elements in the several embodiments. While these descriptions go into specific details of the invention, it should be understood that variations may and do exist and would be apparent to those skilled in the art in view of the following description.

DESCRIPTION OF THE PREFERRED EMBODIMENTS

Specific dimensions set forth below are by way of example for particular embodiments to assist in an understanding of the illustrated structure; these dimensions are not to be construed as limiting the scope of the invention.

Figure 2:
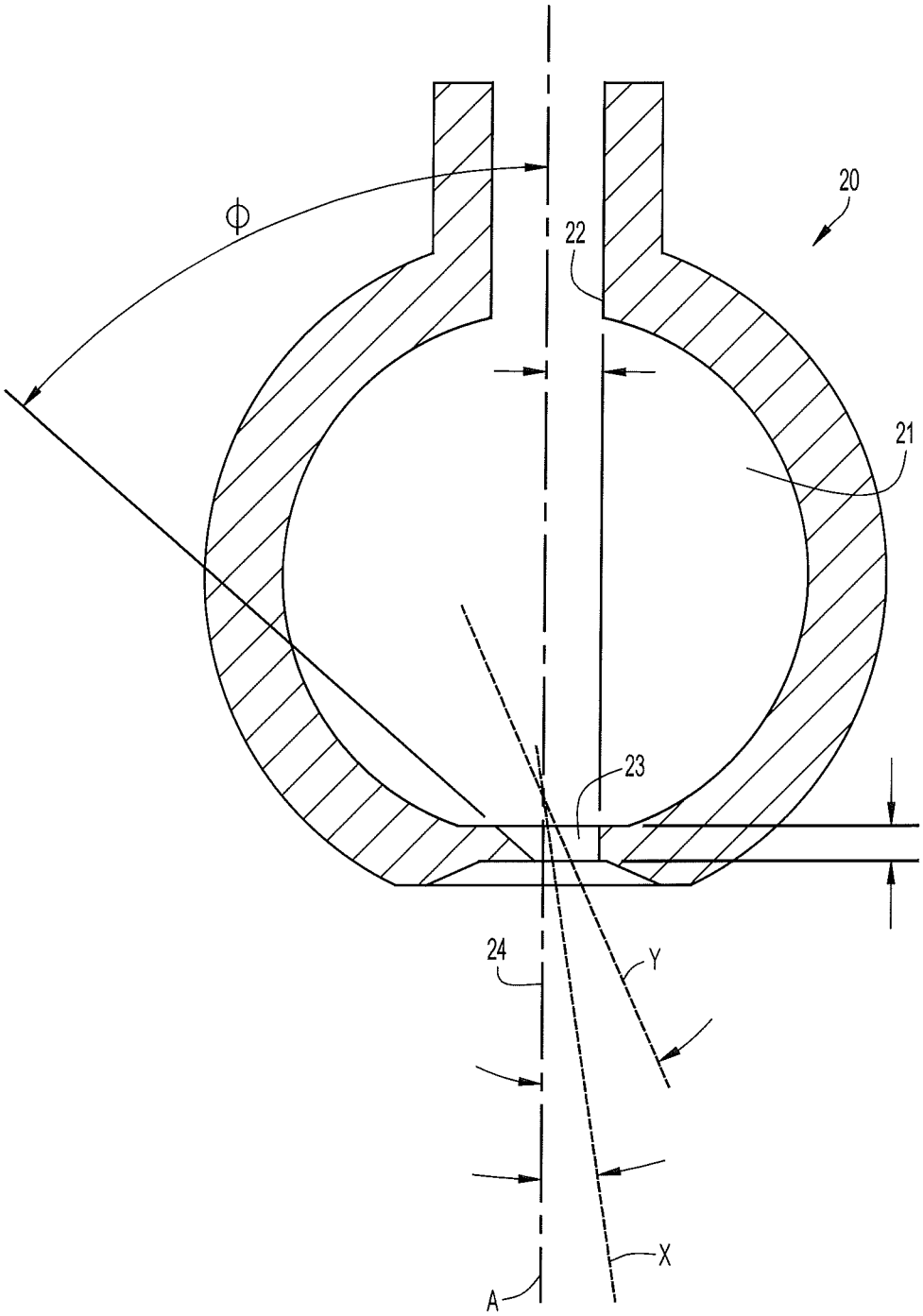
FIG. 2 is a schematic illustration in longitudinal section of illustrating operation of a fluidic scanner oscillator of the present invention.

Referring specifically to FIG. 2 of the accompanying drawings, a fluidic scanner oscillator 20 comprises an interaction chamber 21 of substantially spherical configuration and having a longitudinal axis A. An inlet lumen 22 is disposed preferably concentrically about axis A and is typically connected to a source of pressurized liquid to deliver a jet of the liquid into the upstream end of the chamber. Substantially diametrically opposed to the inlet lumen is an outlet orifice or aperture 23 for issuing the liquid jet to the surrounding ambient environment through a short annular collar region 24 defined as a recess in the outer surface of the chamber wall and diverging from orifice 23.

The periphery of outlet orifice 23 is configured as an irregular conical frustum converging in a downstream direction from the downstream end of the chamber with chamber axis A passing therethrough. The terminus of outlet orifice 23 is an angularly continuous edge of negligible axial length, as opposed to a lumen or passage having finite axial length. The convergence angle of the perimeter of orifice 23 varies angularly (i.e., as a function of perimetric location) such that it is asymmetrically disposed about its own centroid and about axis A. In the illustrated embodiment the maximum convergence angle $\phi$ of orifice 23 relative to axis A is approximately 49° and shown to the left of the axis in FIG. 2; the convergence angle is at a minimum, on the order of 1°, at the diametrically opposed location to the right of the axis in the drawing.

Figure 1B:
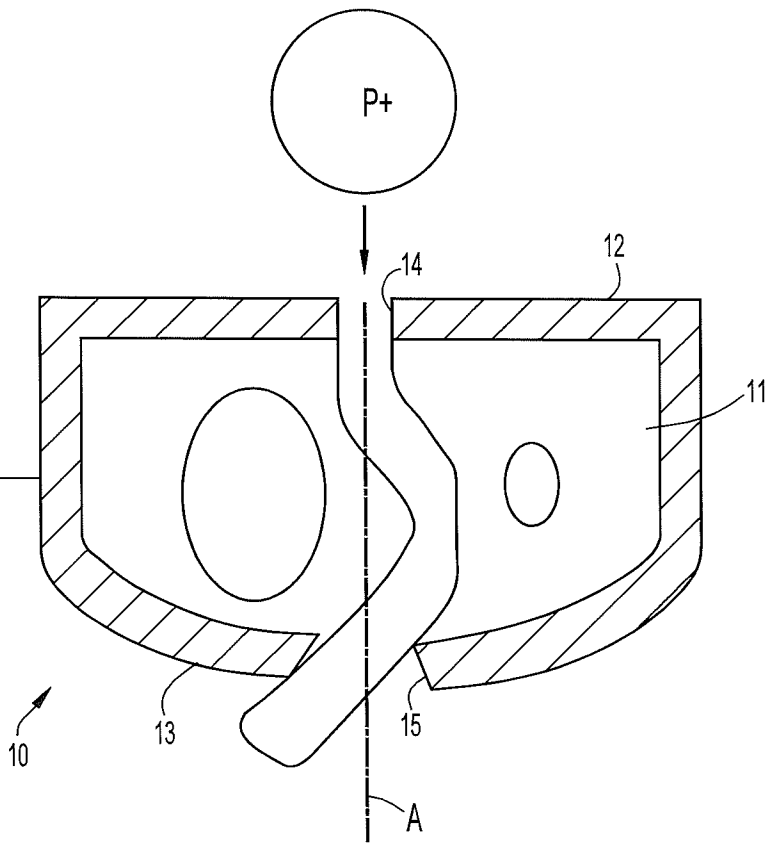
FIG.1B PRIOR ART
FIG. 1B is a schematic illustration of the oscillator of FIG. 1A representing another condition during its operation.
Figure 1A:
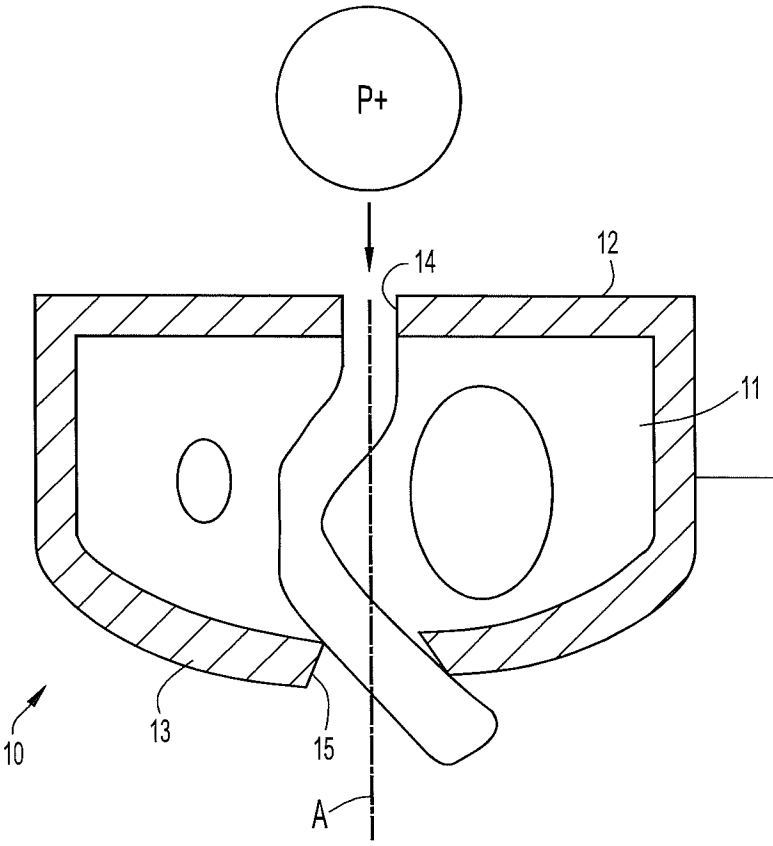
FIG.1A PRIOR ART
FIG. 1A is a schematic illustration of a prior art fluidic scanner-type oscillator representing one condition during its operation.

As described above in connection with the scanning oscillator shown in FIGS. 1A and 1B, a portion of the periphery of the liquid jet that does not exit through outlet orifice 23 is fed back upstream alongside the jet to form a three-dimensional vortical flow pattern (i.e., a doughnut or toroidal shaped vortical flow) axially centered about the chamber axis A. Random perturbations in the flowing liquid cause the vortical flow in the toroid to become diametrically unstable such that the toroid transverse cross-section randomly increases along different angular sections thereof and correspondingly decreases in the toroid sections at correspondingly opposite sides of the chamber. The jet flowing through the chamber and toroid will be deflected away from the larger diameter portion of the toroid and, when so deflected, will cause the spray pattern produced by the jet at outlet orifice 23 to be deflected accordingly. The randomly oscillating deflection of the jet in chamber 21 causes the resulting oscillating outlet jet to break up into a generally conical pattern of liquid droplets about a spray axis that, in the absence of the asymmetry of outlet orifice 23, would be substantially coaxial with chamber axis A. However, as a result of the orifice asymmetry, the axis X of the scanning spray pattern egressing from chamber 20 is skewed (i.e., the spray pattern experiences yaw) relative to axis A by an angle $\theta$ determined by the orifice configuration and transverse position relative to axis A. Moreover, the conical spray pattern becomes asymmetrical as indicated by the nominal boundary line Y of the deflected spray pattern shown in the drawing.

It should be noted that obtaining selected aiming is sensitive to the axial length of the outlet orifice relative to its transverse dimension. If the throat length is too short, the spray aim angle will not be achieved reliably. If the throat angle is too long, then the cone angle of the output spray will be reduced. Also, the entrance angle of the scanner outlet orifice in the particular example illustrated in FIG. 2 (i.e., 49°+1°=50°) must be considered: if the entrance angle is too small, then the cone angle of the spray will be reduced; if the entrance angle is too large, then the desired aim angle of the output spray may not be achieved. As examples of dimensions in embodiments successfully tested, axial lengths of the outlet throats ranged from 0.010 inch to 0.020 inch, and diameters of the downstream throat ends ranged from 0.039 inch to 0.044 inch. In order to effect different skew or aiming angles, the angle of the asymmetrically converging throat wall relative to the chamber axis varied along its periphery between 19° and 31° in one embodiment, between 49° and 1° in another embodiment, between 13° and 37° in a further embodiment, and between 1° and 14° in still a further embodiment.

The ability to redirect the spray pattern axis X as a function of the asymmetry of outlet orifice 23 permits the spray pattern to be aimed as desired. More particularly, in a spray head having a flat front face at which the outlets of a plurality of scanner oscillators are coplanar, differently aimed coplanar oscillators can be positioned by the designer to achieve a wide variety of combined spray patterns and overall spray coverage.

Figure 3:
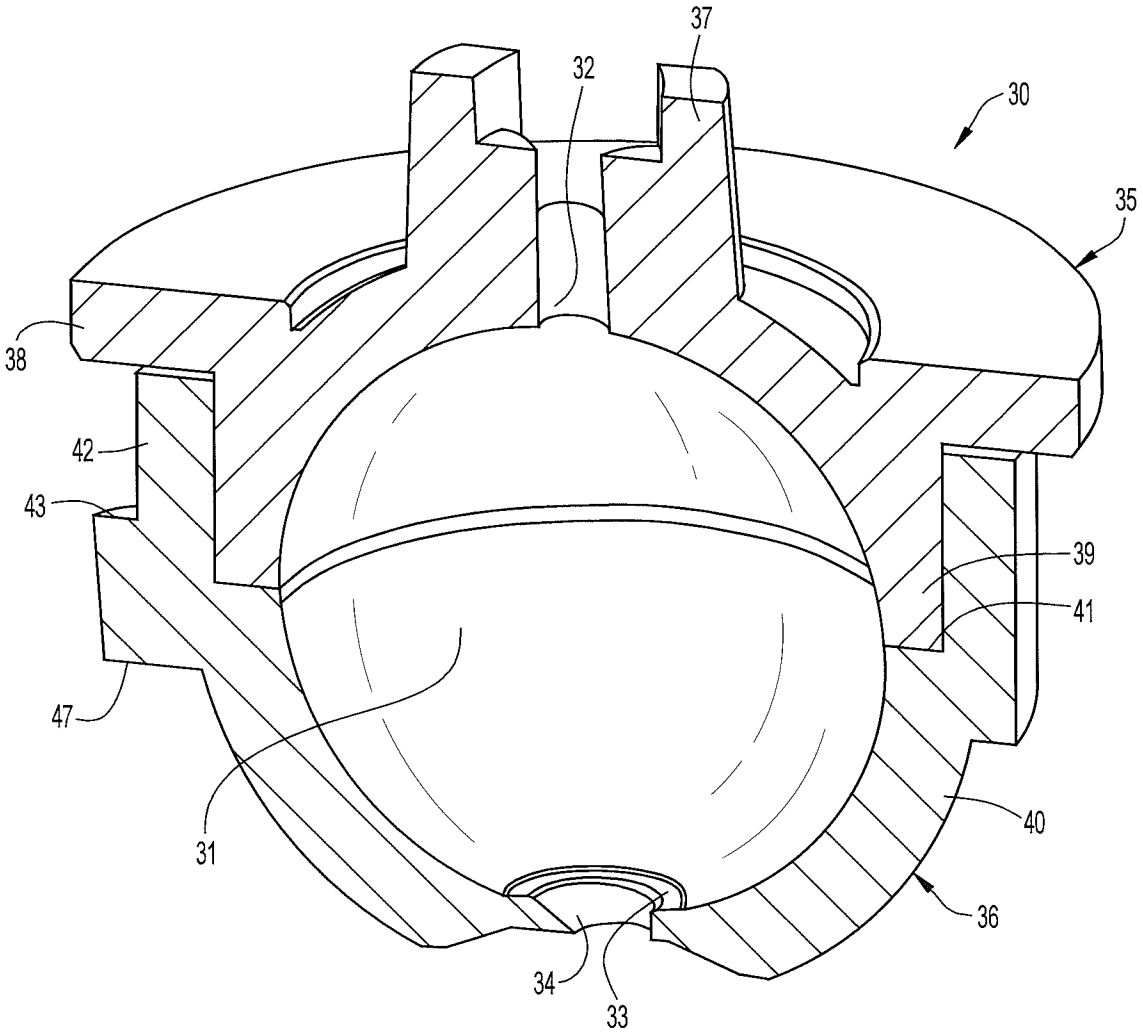
FIG. 3 is a perspective view in longitudinal section of one fluidic scanner oscillator embodiment of the present invention FIG. 2.
Figure 6A:
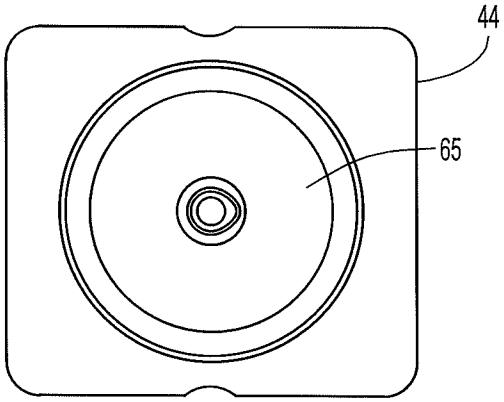
FIG. 6A is a top view in plan of the bottom portion of yet another embodiment of the scanner oscillator of the present invention.
Figure 6B:
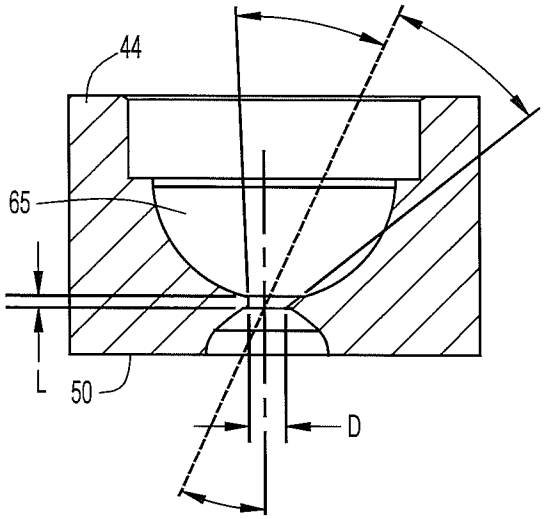
FIG. 6B is a view in longitudinal section of the scanner oscillator of FIG. 6A.

The oscillator 30 illustrated in FIG. 3 is functionally the same as oscillator 20 of FIG. 2 and is made in two parts, a top part 35 and bottom part 36, to define a generally spherical interaction chamber in two respective halves joined at their bases. Top part 35 includes an inlet connector 37 extending upstream from its top in which liquid inlet lumen or passage 32 to chamber 31 is defined. A hemispherical downward-facing surface of top part 35 defines the upper half of interaction chamber 31 and is bounded perimetrically by a depending cylindrical wall 39. An annular flange 38 projects radially outward from wall 39.

Bottom part 36 has a hemispherical upward-facing surface defining the lower half of chamber 31 and has the oscillator's asymmetrical outlet orifice 33 and surrounding collar region 34 defined therethrough. The wall 40 of bottom part 36 includes an annular ledge 41 surrounding the rim of the lower half of chamber 31. At the radial outer extremity of ledge 41 the wall 40 extends upwardly as a cylindrical section 42, radially spaced from the chamber. The resulting annular space is configured for receiving depending cylindrical wall 39 of top part 35. With top part 35 and bottom part 36 thusly joined, the bottom edge of wall 39 abuts ledge 41. Similarly, the annular upper edge of wall section 42 abuts the bottom surface of ledge 41, and the circumferential inner surface of wall section 42 abuts the circumferential outer surface of wall 39. These abutting surfaces facilitate sealing between parts 35 and 36, either by tight fit abutment, the use of one or more grommets, silicone sealant or the like, or any combination thereof. The bottom surface 47 of wall section 42 projects radially outward from wall 40 and serves as a support flange for the assembly as described in connection with the showerhead of FIG. 13. An indexing or positioning tab 43 extends a short distance radially outward at a predetermined angular location on the periphery of wall section 42. Tab 43 permits oscillator 30 to be positioned in a predetermined angular orientation in a showerhead, or the like, as described hereinbelow in in relation to FIG. 13.

Figure 5A:
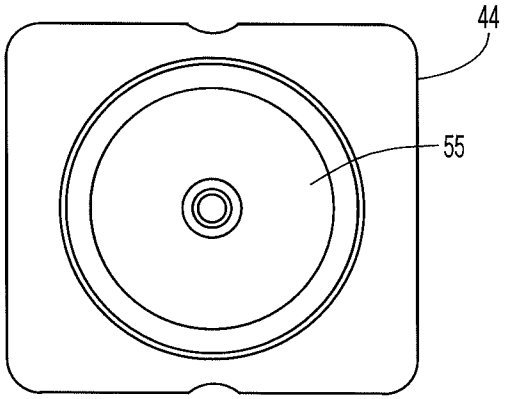
FIG. 5A is a top view in plan of the bottom portion of another embodiment of the scanner oscillator of the present invention.
Figure 5B:
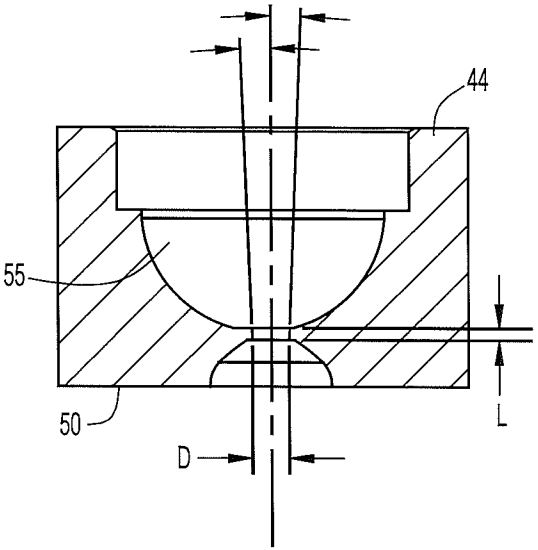
FIG. 5B is a view in longitudinal section of the scanner oscillator of FIG. 5A.
Figure 4A:
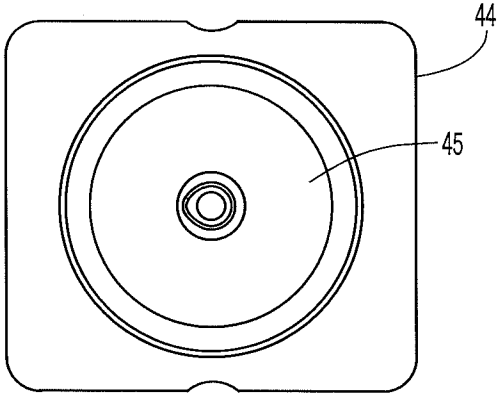
FIG. 4A is a top view in plan of the bottom portion of another embodiment of the scanner oscillator of the present invention.
Figure 4B:
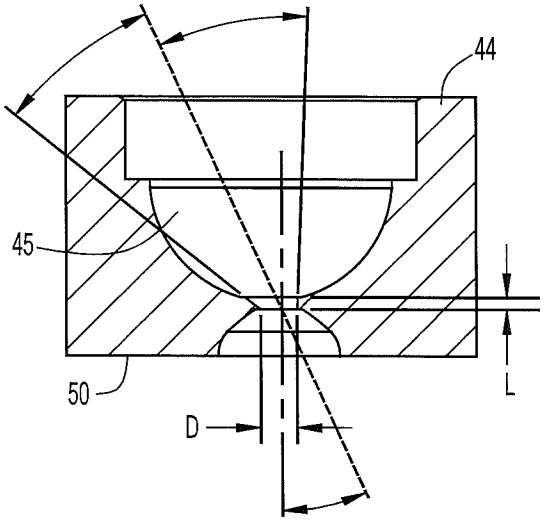
FIG. 4B is a view in longitudinal section of the scanner oscillator of FIG. 4A.

The bottom hemispherical parts of fluidic scanner oscillators 45, 55 and 65, each of the general type illustrated in FIGS. 2 and 3, are illustrated in FIGS. 4A & 4B, 5A and & 5B and 6A & 6B, respectively. Each oscillator is molded into a sprayer unit 44, only a downstream portion of which is shown in these drawings, the planar bottom surface 50 of which is the face of the sprayer. Oscillator nozzles 45, 55 and 65 are substantially identical except for the configurations of their respective outlet orifices which are asymmetrically (or symmetrically for no skewing or yaw) contoured as described above to effect different aiming directions. Specifically, the outlet orifice in oscillator 45 is asymmetrically configured relative to the oscillator axis identically to the outlet orifice 23 in FIG. 2, such that the aim angle of the outlet spray is deflected downward to the right. The outlet orifice in oscillator 55 is symmetrical about the oscillator axis so that there is no deflection of the spray pattern axis from the oscillator axis. The outlet orifice in oscillator 65 is asymmetrically configured relative to the oscillator axis such that the aim angle of the outlet spray is deflected downward to the left.

Figure 7:
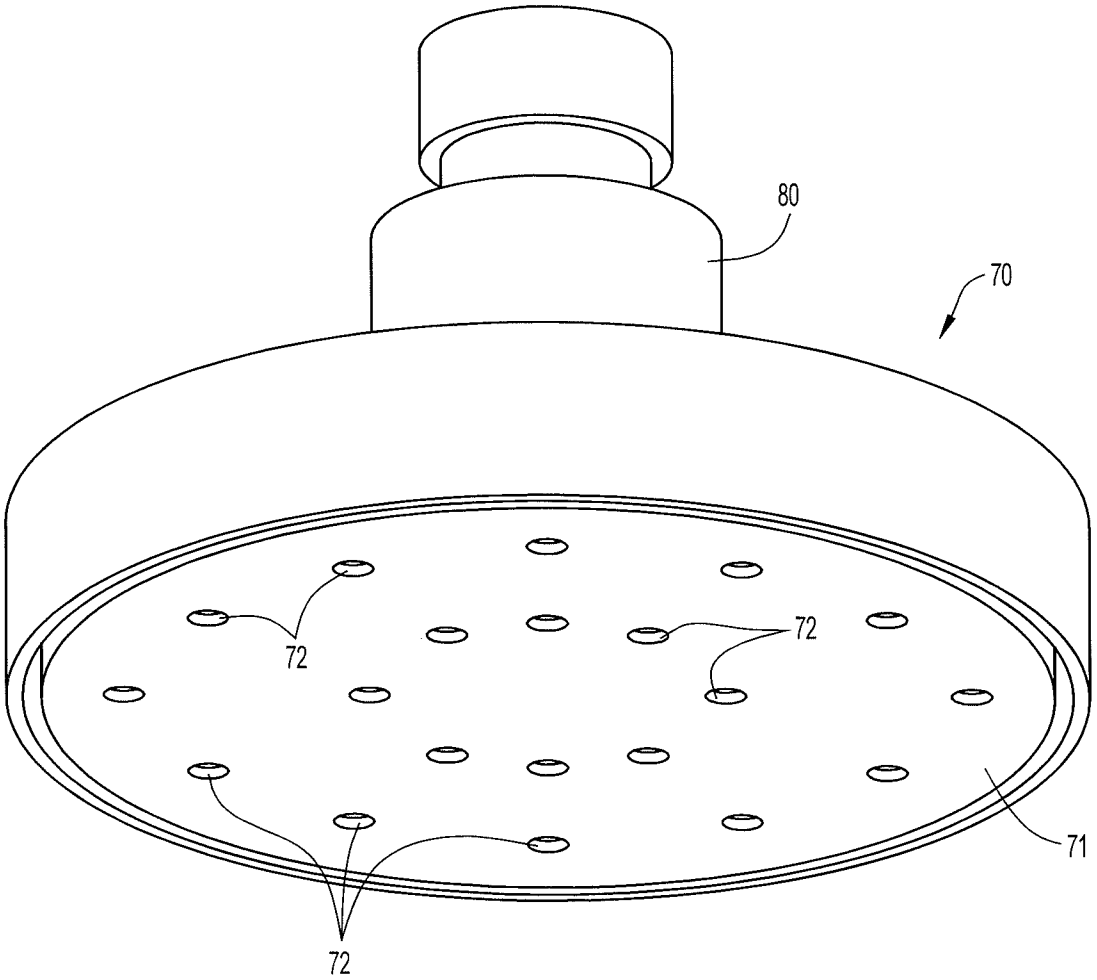
FIG. 7 is a view in perspective from below of a showerhead of the present invention.
Figure 8:
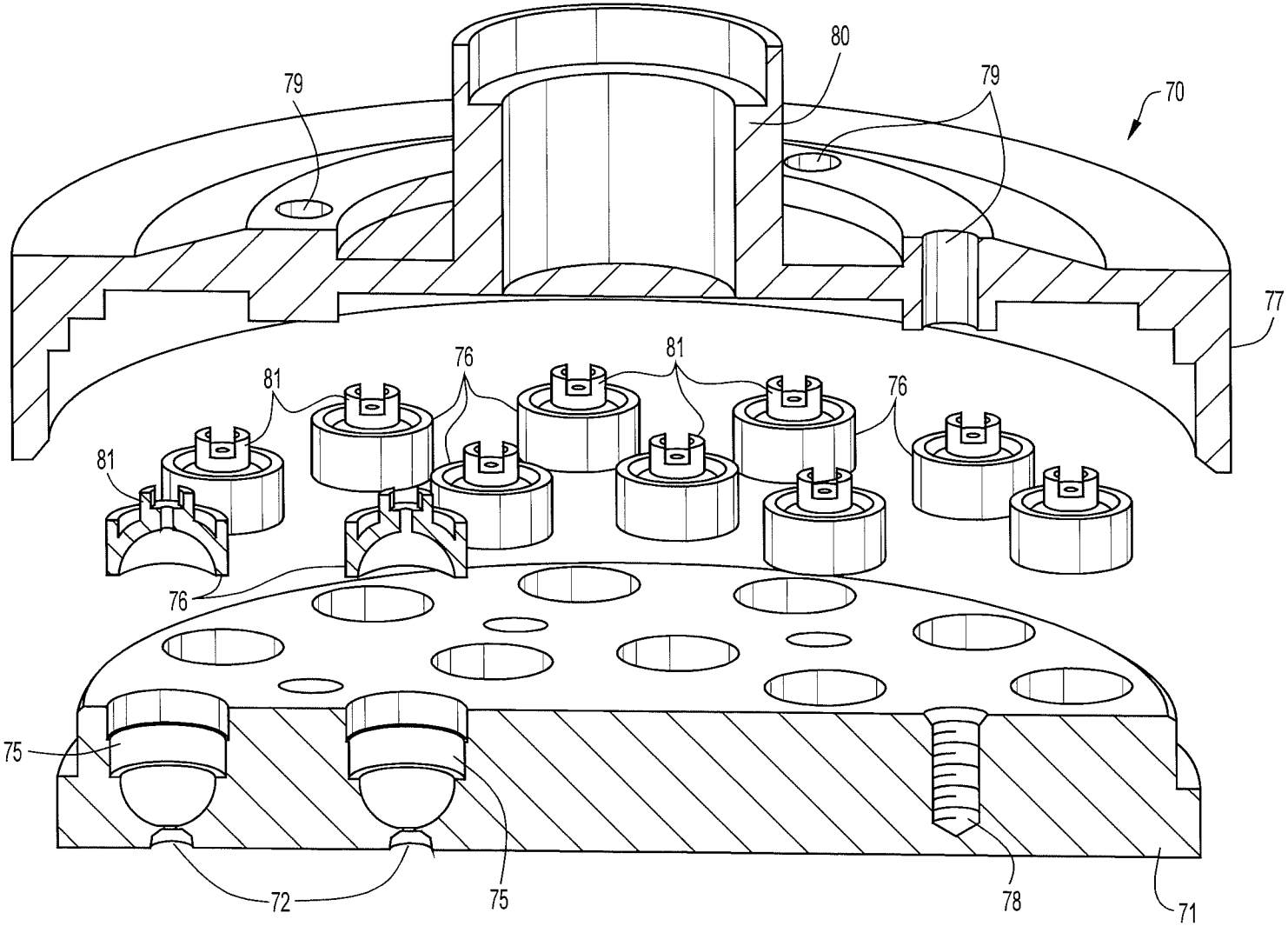
FIG. 8 is an exploded view in longitudinal section of an embodiment of the showerhead of FIG. 7 employing fluidic scanner oscillators of the present invention partially molded into the showerhead faceplate.
Figure 9:
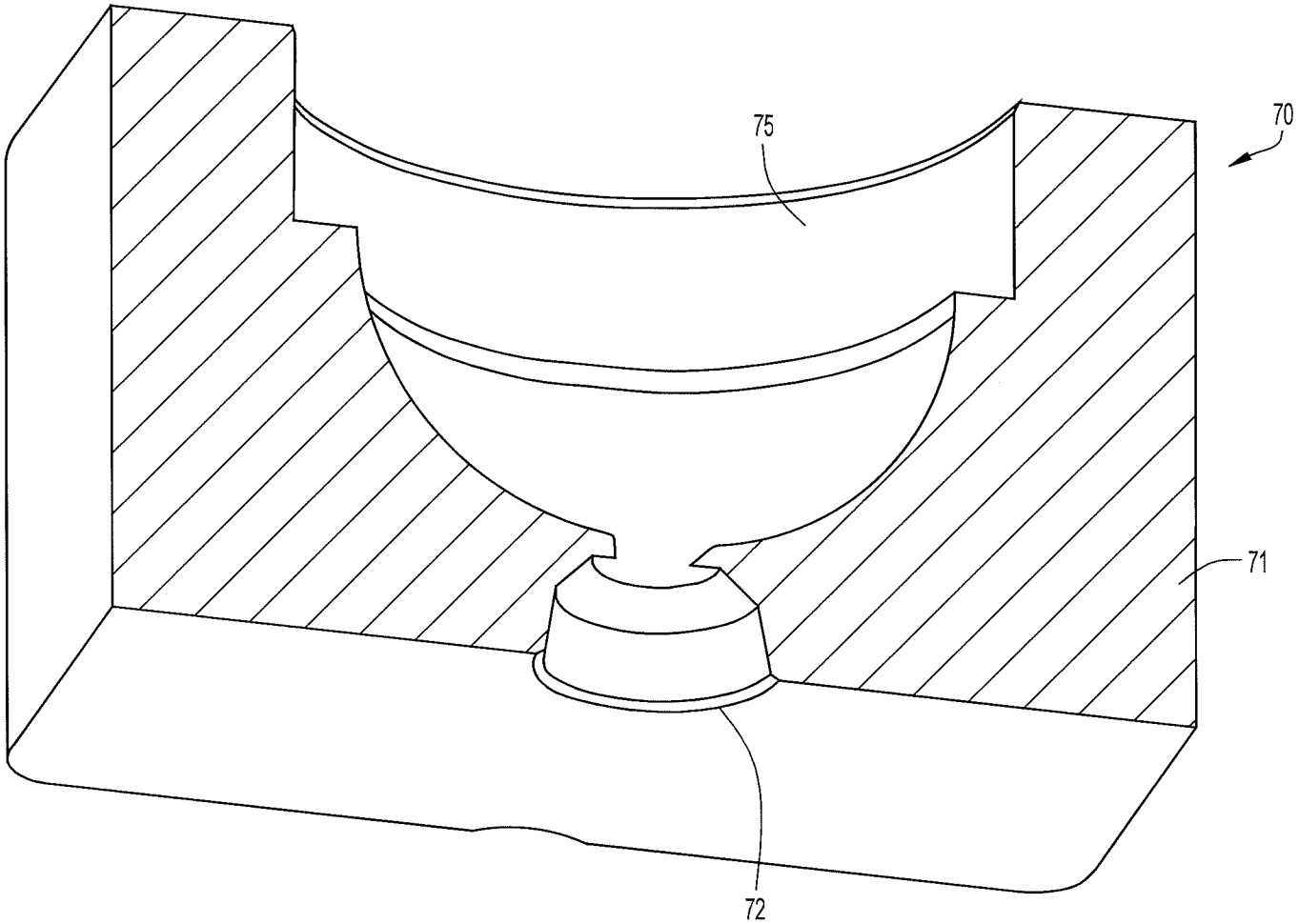
FIG. 9 is a partial perspective view from below in longitudinal section of the showerhead faceplate of FIG. 8 showing a bottom portion of a fluidic scanner oscillator of the invention molded into the faceplate.
Figure 10A:
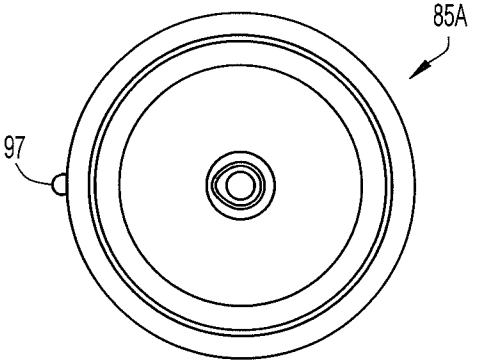
FIG. 10A is a top view in plan of the bottom portion of still another embodiment of the fluidic scanner oscillator of the present invention.
Figure 10B:
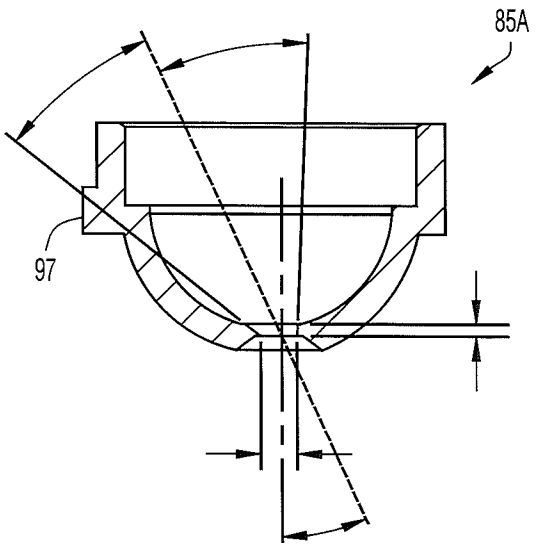
FIG. 10B is a view in longitudinal section of the fluidic scanner oscillator of FIG. 10A.
Figure 11A:
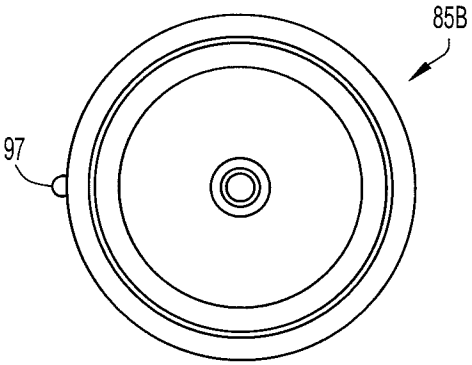
FIG. 11A is a top view in plan of the bottom portion of a further embodiment of the fluidic scanner oscillator of the present invention.
Figure 11B:
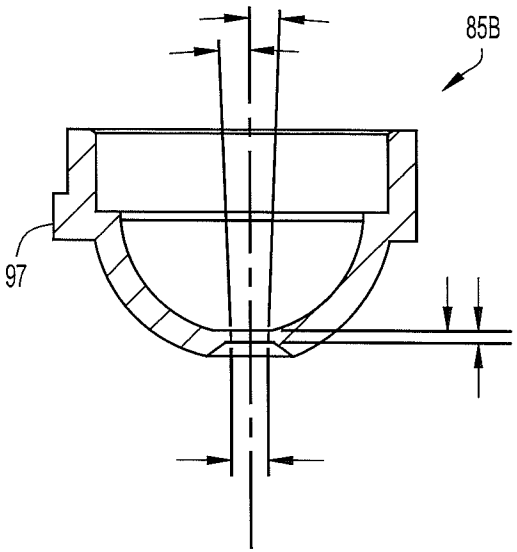
FIG. 11B is a view in longitudinal section of the fluidic scanner oscillator of FIG. 11A.
Figure 12A:
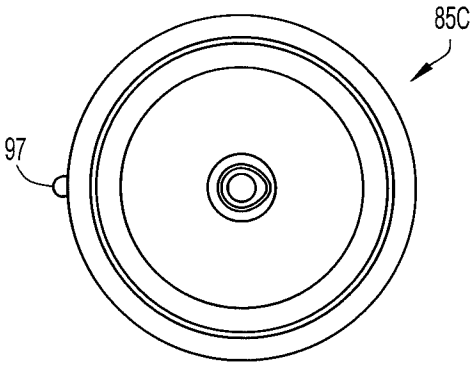
FIG. 12A is a top view in plan of the bottom portion of still a further embodiment of the fluidic scanner oscillator of the present invention.
Figure 12B:
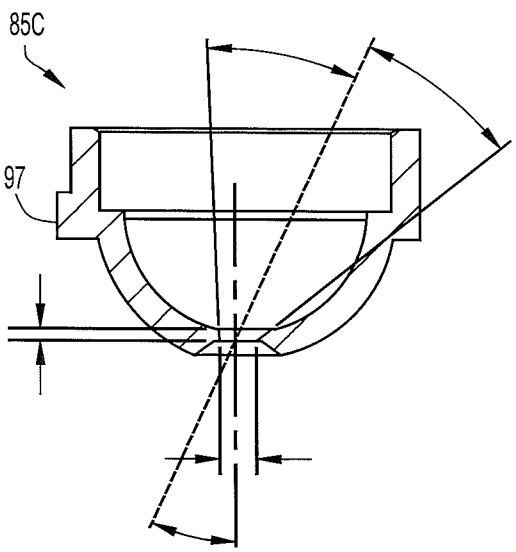
FIG. 12B is a view in longitudinal section of the fluidic scanner oscillator of FIG. 12A.

It will be appreciated that any number of oscillators can be thusly combined in a sprayer with their aim angles selected to effect a desired overall spray pattern. As an example, a showerhead 70 employing plural fluidic scanner nozzles of the present invention is illustrated in FIGS. 7, 8 and 9. Showerhead 70 comprises a faceplate 71 having a substantially planar front surface and with multiple spray openings 72 defined therein, each opening configured to issue a spray pattern from a respective fluidic scanner nozzle. The fluidic scanner nozzles are preferably arrayed in the circular faceplate 71 at different radial distances from the plate center to cooperate with the aiming angles of the scanner nozzles so that the resultant spray from the showerhead provides a widely distributed and uniform distribution of water droplets.

The bottom parts 75 of fluidic scanner nozzles of the type illustrated in FIGS. 4A, 4B and 5A, 5B and 6A, 6B are molded as part of faceplate 71 and extend therethrough. In assembling the showerhead the top parts 76 of these nozzles, which are substantially similar to the nozzle top parts 35 in FIG. 3 without the positioning tabs 43, are placed in the faceplate 71 from above to join with and communicate with respective bottom parts 75. The faceplate is then placed in the showerhead housing 77 and secured and sealed therein by screws (not shown) extending through appropriate bores 79 defined through housing and into threaded bores 78 defined in the faceplate. Pressurized water is received via a showerhead inlet fitting 80 which is preferably made of a metal such as brass, or of plastic or the like, and is adapted to engage a fitting such as a standard ½-inch pipe fitting. The received water is delivered to the various oscillator nozzles via respective inlet connectors 81 formed as a portion of the upper parts 76 of the nozzles and which are configured similarly to connector 37 in FIG. 3. In this regard, when faceplate 71 is sealed in housing 77 there is an open volume or space above the faceplate that receives the pressurized water and serves as a manifold from which the turbulently flowing water is distributed to the connectors 81. Alternatively, housing 77 may be provided with fittings integrally formed therein to receive respective connectors 81.

Figure 13:
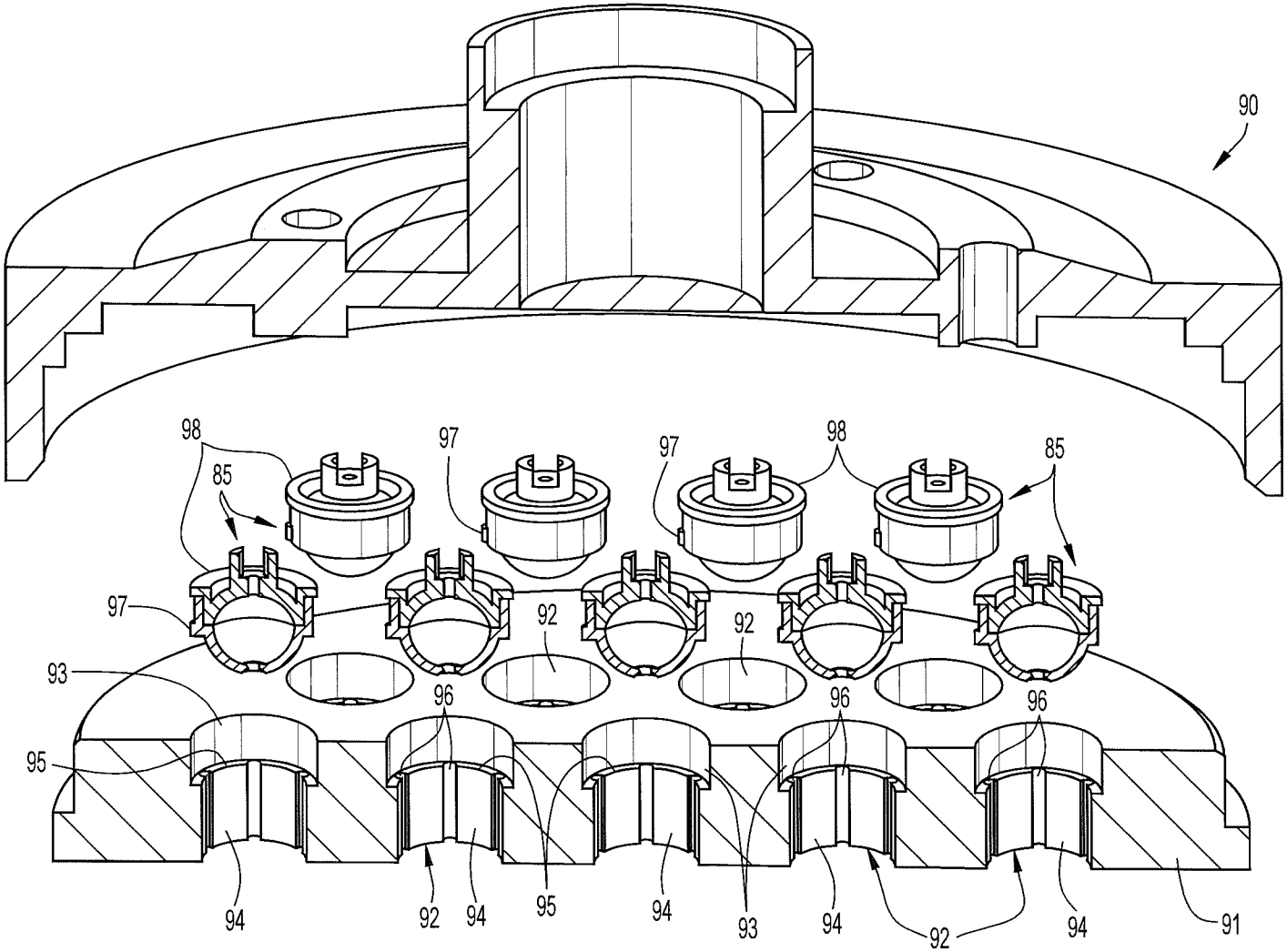
FIG. 13 is an exploded view in longitudinal section of another embodiment of the showerhead of the present invention employing fluidic scanner oscillators of the type illustrated in FIG. 3.

Instead of molding the bottom part of the fluidic nozzles as part of a showerhead faceplate, a plurality of fluidic scanner nozzles 85A, 85B, 85C of the type illustrated in FIG. 3 may be disposed as respective nozzle units in an appropriately configured faceplate 91 of a showerhead 90 as illustrated in FIG. 13. The bottom parts of three such nozzles are illustrated in FIGS. 10A & 10B, 11A & 11B and 12A & 12B, each shown to have a respective aim angle as described in connection with the embodiments illustrated in FIGS. 4A & 4B, 5A & 5B and 6A & 6B. The faceplate 91 has a plurality of bores 92 defined therethrough for receiving respective scanner nozzles 85. Each bore 92 includes an upper cylindrical section 93 of a relatively large diameter and a lower cylindrical section 94 of relatively smaller diameter, the demarcation between the sections being defined by an annular shoulder 95. Each nozzle 85 includes an annular support flange 98, configured similarly to support flange 47 of FIG. 3, and arranged to abut shoulder 95 when a scanner nozzle is fully longitudinally inserted into a respective bore 92. In this position the bottom portion of the scanner nozzle extends into the lower section 94 of the bore with the upper part of the nozzle residing in the upper bore section 93.

One or more longitudinally extending indexing slots 96 are defined at different angular positions in the boundary wall of lower section 94 and are configured to longitudinally receive and angularly engage a indexing or positioning tab 97 extending radially from the outer wall of the bottom section of each scanner nozzle 85. Positioning tabs 97 are configured substantially the same as positioning tab 43 described in connection with FIG. 3. Insertion of a scanner nozzle 85 into any bore 92 is prevented unless the nozzle positioning tab 97 is angularly aligned and engaged with one of the indexing slots 96 defined in that bore. This permits a nozzle having a specific aim axis direction to have its location in the showerhead nozzle array predetermined, permits specific design and preselection of the overall pattern of the showerhead spray. In other words, oscillator nozzles having specific aim angles and be inserted into the faceplate in specific angular orientations to effect a desired three-dimensional combined outlet spray pattern for the showerhead.

This scanner nozzle configuration and showerhead assembly and method of the present invention provide some significant advantages, including:

1. The simplicity of the scanner nozzle member geometry, which includes an essentially spherical interaction region with coaxial, opposed inlet lumen (i.e., power nozzle) and outlet orifice or throat, allows for simplified construction of scanner fluidic arrays.
   a. All of the scanner nozzle throats with the downstream half of the interaction regions can be molded in one piece of the showerhead. In this embodiment, the power nozzle and upstream half of the interaction region are molded individually for each nozzle. The component count is equal to the number of fluidic nozzles plus one, which greater than in some prior fluidic showerheads, but the components are much simpler to design, mold, and assemble.
   b. All of the scanner throats with the downstream half of the interaction regions can be molded in one piece of the showerhead and all of the power nozzles and upstream half of the interaction regions can be molded in one other piece of the showerhead. In this scenario, component count for the fluidics is two, no matter how many fluidics are included. This embodiment also allows each showerhead to be designed and built to whatever scanner fluidic geometry is best suited rather than using more or less standard components that are typical in prior fluidic showerheads.
      i. To facilitate the alignment of a large number of fluidic nozzles in the assembly, one of the components may be molded out of a flexible material to allow it to conform to the other hard plastic component.
      ii. To facilitate the alignment of a large number of fluidics in the assembly of the present invention and to allow aiming or bending of the fluidics into various aim angles, both of the components may be molded out of a flexible material to allow them to conform to each other and to a hard face or backing plate that holds prescribed aim angles.
2. The economy inherent in the manufacturing process for making the scanner nozzles and the showerhead nozzle assembly (i.e., the essentially spherical interaction region coaxial opposed inlet and outlet) provide the option of economically molding the downstream parts of the interaction regions in the one piece of the showerhead assembly. Since the inlet lumen and upstream half of the interaction region are molded individually for each fluidic, the assembly of the showerhead is simplified and the components are much simpler to design and mold.

As described, the bottom parts of showerhead nozzles may be molded together economically in a single molding operation, and this rapid and economical fabrication method provides a showerhead or nozzle assembly that reliably generates sprays covering large coverage areas with uniform coverage across target area. The method and structure of the present invention thus provides a practical way to make the throat sides of the distinct scanner inserts in a scanner array in a single molded piece in commercially available "open and close" tooling, by providing arrays with selected aiming features molded into the throats of each scanner insert.

The scanner fluidic nozzle geometry of the present invention does not require a large surface seal as is required in prior fluidic nozzles; rather the nozzle of the present invention is molded in two parts that are joined by a very simple cylindrical seal which is much more robust than a large surface seal.

As noted herein, although the invention has been disclosed with primary application for a showerhead, the principles are equally applicable for and sprayer unit requiring area coverage of liquid spray.

Having described preferred embodiments of new and improved fluidic scanner nozzles and sprayer assemblies employing same, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A fluidic scanner nozzle comprising:

an interaction chamber defined longitudinally between an upstream end and a downstream end and having a longitudinal chamber axis (A), first and second members secured and sealed together to define said interaction chamber therebetween, said first member including said upstream end and a first open end longitudinally opposite an inlet opening, said second member including said downstream wall and a second open end longitudinally opposite an outlet orifice, and wherein said first and second members are joined at said first and second open ends;

said upstream end including a hemispherical downward facing surface having said inlet opening for receiving pressurized fluid and delivering the pressurized liquid as a jet into said chamber along said chamber axis;

said downstream end including a hemispherical upward facing surface having said outlet orifice for issuing a substantially conical outlet spray of liquid droplets from said chamber into ambient environment;

wherein said outlet orifice is asymmetric relative to said chamber axis to thereby skew the direction of the liquid outlet spray relative to the chamber axis;

wherein the interaction chamber is configured to deflect said jet in three dimensions relative to said longitudinal chamber axis such that the jet, upon issuing from said outlet orifice, forms said spray pattern in a substantially conical configuration of liquid droplets about a spray axis; and wherein the nozzle is disposed in a first bore defined through a plate of a sprayer along with a plurality of said nozzles disposed in respective additional bores defined through the plate, wherein said first or second member includes an angular positioning tab projecting radially outward therefrom at a predetermined angular location about the chamber axis, and wherein said plate has at least one indexing slot defined longitudinally at the periphery of said first bore and arranged to receive and rotationally engage said positioning tab with said nozzle in an angular position determined by the angular location of said indexing slot.

2. The scanner nozzle of claim 1 wherein said outlet orifice is asymmetric about its centroid.

3. The scanner nozzle of claim 1 wherein said outlet converges in a downstream direction at an angle of convergence that varies with perimetric location about the orifice.

4. The scanner nozzle of claim 1 wherein the centroid of the outlet orifice is transversely offset from the chamber axis.

5. The scanner nozzle of claim 1 wherein said outlet orifice is configured as a conical frustum converging in a downstream direction.

6. The scanner nozzle of claim 1 wherein said upstream and downstream ends are configured as substantially spherical segments having respective bases at which said segments are joined.

7. The scanner nozzle of claim 1 wherein said second member is defined in and through a plate of a sprayer in which a plurality of said second members of a respective plurality of scanner nozzles are formed integrally therein in an array.

8. The scanner nozzle of claim 7 wherein said plate is a front plate of a shower head.

* * * * *